US009708886B2

(12) United States Patent
Frenzel et al.

(10) Patent No.: US 9,708,886 B2
(45) Date of Patent: Jul. 18, 2017

(54) CONTROL CHOKE SYSTEM

(71) Applicant: Cameron International Corporation, Houston, TX (US)

(72) Inventors: Robert A. Frenzel, Waller, TX (US); Jerry Martino, Houston, TX (US); Stephen Chambers, Westmeath (IE); Ali Barkatally, Spring, TX (US)

(73) Assignee: Cameron International Corporation, Houston, TX (US)

( * ) Notice: Subject to any disclaimer, the term of this patent is extended or adjusted under 35 U.S.C. 154(b) by 506 days.

(21) Appl. No.: 14/207,214

(22) Filed: Mar. 12, 2014

(65) Prior Publication Data

US 2014/0262333 A1 Sep. 18, 2014

Related U.S. Application Data

(60) Provisional application No. 61/800,692, filed on Mar. 15, 2013.

(51) Int. Cl.
*E21B 34/02* (2006.01)
*E21B 43/12* (2006.01)

(52) U.S. Cl.
CPC ..... *E21B 34/02* (2013.01); *E21B 43/12* (2013.01)

(58) Field of Classification Search
CPC ..... E21B 34/02; E21B 33/068
See application file for complete search history.

(56) References Cited

U.S. PATENT DOCUMENTS 4,230,299 A 10/1980 Pierce
4,471,810 A * 9/1984 Muchow ..... F16K 39/04 137/625.37
4,971,099 A 11/1990 Cyvas
5,086,808 A 2/1992 Pettus
6,659,419 B2 * 12/2003 Chatufale ..... F16K 31/143 222/334
6,883,614 B2 * 4/2005 Schmidt ..... F16K 39/04 166/316
8,360,391 B2 * 1/2013 Morris ..... F16K 3/262 251/111
8,402,996 B2 * 3/2013 Piwonka ..... E21B 34/00 137/553
2004/0216888 A1 * 11/2004 Schmidt ..... F16K 39/04 166/377
2014/0020909 A1 * 1/2014 McKeon ..... E21B 34/02 166/379
2014/0262333 A1 * 9/2014 Frenzel ..... E21B 34/02 166/378

FOREIGN PATENT DOCUMENTS

GB 2462879 A 3/2010

OTHER PUBLICATIONS

PCT ISR & WO for PCT/US2014/026228, mailed Feb. 18, 2015.

* cited by examiner

*Primary Examiner* — Jennifer H Gay
(74) *Attorney, Agent, or Firm* — Fletcher Yoder, P.C.

(57) ABSTRACT

A system includes a wellhead system, and a flow control system coupled to the wellhead system. The flow control system includes a housing with a flow path between an inlet and an outlet. The flow control system also includes a flow control device disposed in the housing along the flow path. The flow control system also includes a bonnet assembly surrounding the flow control device. The bonnet assembly is configured to selectively mount one of a manual actuator and a powered actuator to actuate the flow control device.

36 Claims, 5 Drawing Sheets

CONTROL CHOKE SYSTEM

CROSS-REFERENCE TO RELATED APPLICATION

This application is a Non-Provisional application and claims priority to U.S. Provisional Patent Application No. 61/800,692, entitled "Control Choke System", filed Mar. 15, 2013, which is herein incorporated by reference.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wellhead systems use flow control devices (e.g., valves, chokes, etc.) to control fluid (e.g., oil or gas) flow in mineral extraction operations. Flow control devices typically control pressure and fluid flow into flowlines, which then move the extracted minerals to processing plants or other locations. And the flow control device typically has an actuator that actuates a trim or cage to increase, or decrease, pressure and flow. The actuator may be manual, or powered hydraulically, electrically, or pneumatically, for example. In certain instances, the operator may want to change the actuator type. But swapping the actuator traditionally requires taking the flow control device offline (e.g., no flow) for an extended period of time to change actuator mounting components, for instance, leading to unwanted downtime.

Furthermore, existing flow control devices for mineral extraction operations may be prohibitively expensive for low pressure, low flow rate mineral extraction operations, as are often encountered with "shale-play" hydrocarbons.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a modular flow control system capable of accommodating transition from a manual actuator to a powered actuator, or vice versa, without interrupting mineral extraction operations. For example, in the beginning phases of mineral extraction operations, the actuator in the modular flow control system may be a manual actuator. In another phase (e.g., steady state), it may be desirable to transition to a powered actuator. In addition, certain embodiments envisage modularized portions of the flow control system, facilitating use of components made from different materials (e.g., expensive and inexpensive materials). Accordingly, the flow control system may use fewer expensive components, reducing the overall cost of the system.

Figure 1:
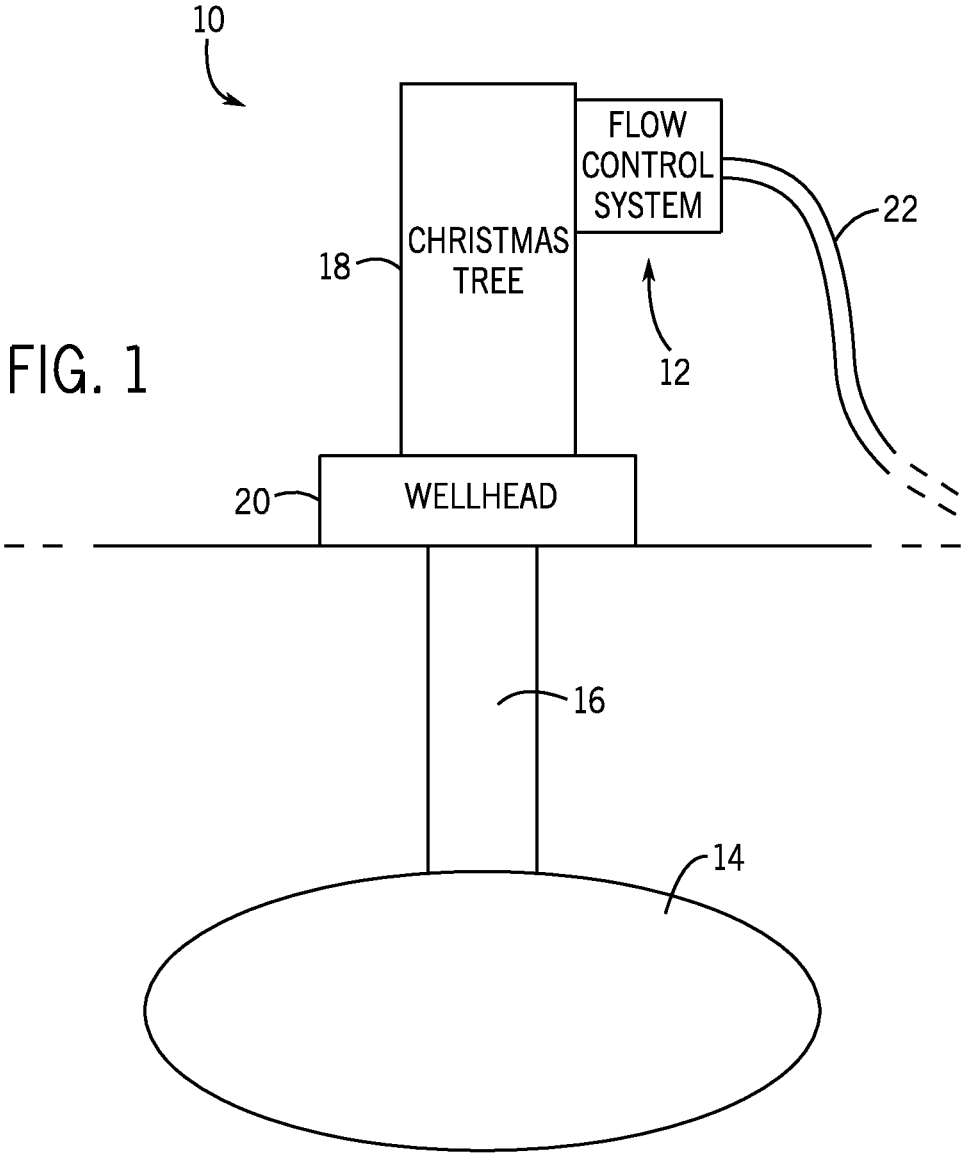
FIG. 1 is a schematic diagram of a wellhead system with a modular flow control system.

FIG. 1 is a schematic diagram of a wellhead system 10 with a modular flow control system 12, which may be a choke or a valve, for example. The wellhead system 10 facilitates extraction of oil, natural gas, and other natural resources from a natural resource reservoir 14 through a well 16. The illustrated mineral extraction system 10 includes the modular flow control system 12, Christmas tree 18, wellhead 20, and flowline 22. In operation, the wellhead system 10 controls the ingress of egress of fluids between the subterranean well 16 and the surrounding environment. And the illustrated modular flow control system 12 controls the pressure and flow rate of the extracted fluids and minerals going to the flowline 22.

The illustrated modular flow control system 12 may operate with a manual or powered actuator. Manual actuators typically have a handwheel or machined stem that can be actuated by an operator. Powered actuators generate motive force from electrical current, hydraulic fluid, a pneumatic source, or a combination thereof, to name but a few options.

An operator may wish to use a manual actuator during initial phases of mineral extraction operations; however, in later phases (e.g., steady state), it may be beneficial to replace the manual actuator with a powered actuator. Typically, during initial set-up, there is frequent activity (and, thus, a greater number of service technicians) around the wellhead system 10 available to operate the manual actuator. However, during the more steady-state production phase, there is less activity and, in turn, fewer technicians available. During steady-state production, the exemplary modular flow control system 12 has a controller located at a remote location to control the powered actuator. The controller receives sensor inputs and feedback from the wellhead system, and facilitates control of the power actuator from the remote location. Alternatively, the controller may be local to the wellhead system and operate the powered actuator in an autonomous or semi-autonomous manner. This facilitates operation of the system 10 without the constant supervision of an operator. Advantageously, the actuators for illustrated modular flow control system 12 may be changed without stopping or interrupting the flow of minerals. This capability can save time and money by preventing costly shutdowns of the wellhead system 10 during repair, upgrading, or replacement of the actuator. Moreover, the modular flow control system 12 enables component construction out of expensive and inexpensive materials, reducing the overall cost.

Figure 2:
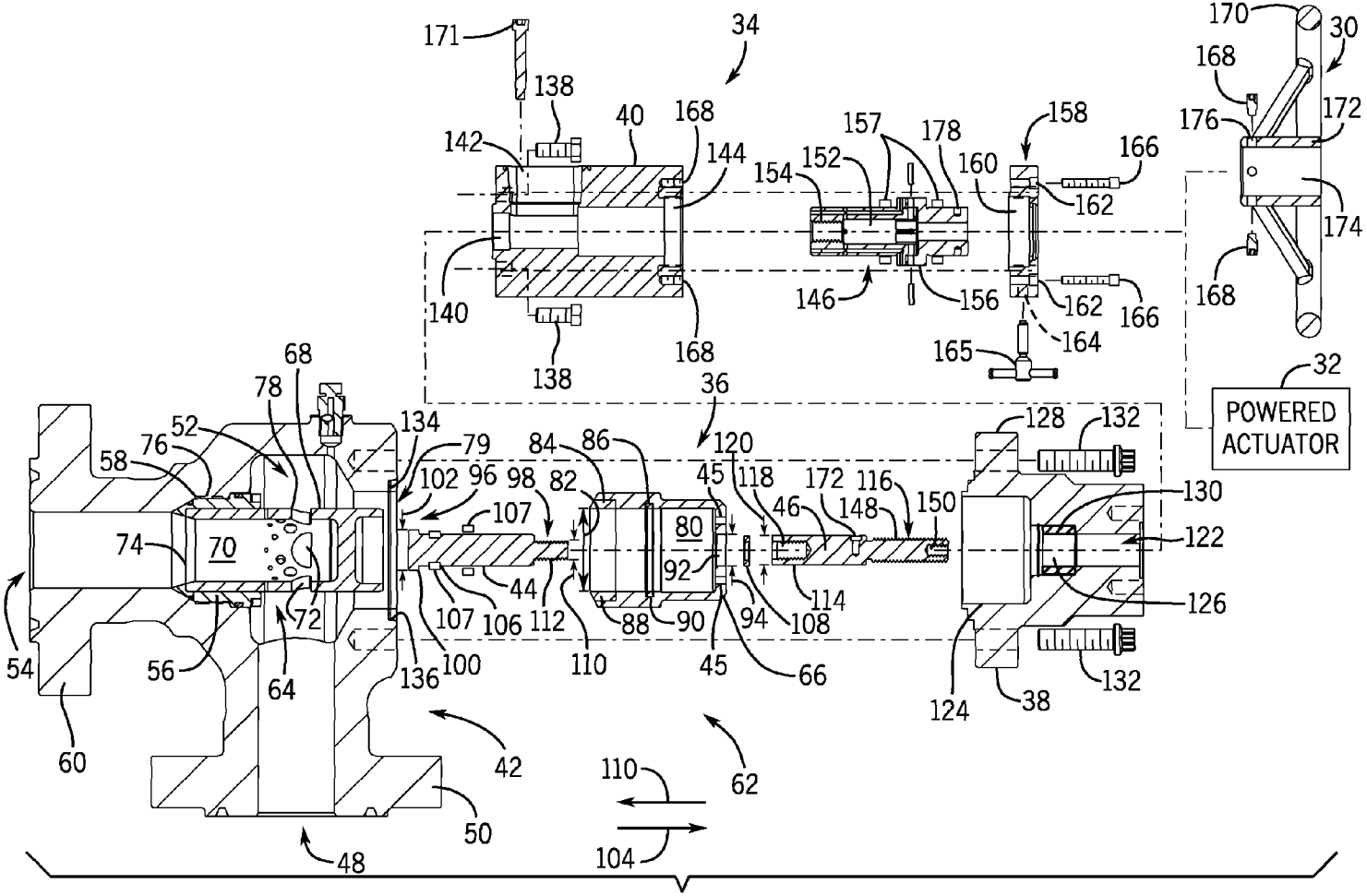
FIG. 2 is an exploded cross-sectional view of a modular flow control system capable of receiving either a manual or powered actuator.

FIG. 2 is an exploded cross-sectional view of a modular flow control system 12 capable of receiving either a manual actuator 30 or a powered actuator 32. The modularity of the flow control system 12 enables an inexpensive construction (i.e., different materials for different components). Specifically, because the modular flow control system 12 may operate in low flow and low pressure conditions, it would experience less stress during operation in such conditions. Therefore, the modular flow control system 12 enables the use of components made from less expensive materials capable of withstanding the expected operational stresses. The illustrated system 12 is a choke; however, the present invention is equally applicable to other types of flow control systems, such as ball valves, butterfly valves, in-line chokes, gate valves, BOP assemblies, to name but a few.

The illustrated choke 12 uses different components formed from different materials for a modular bonnet assembly 34 and modular stem assembly 36. The bonnet assembly 34 includes a bonnet 38 and a modular bracket 40. The bonnet 38 is made of a more durable, expensive material (e.g., a higher-strength or treated steel) while the modular bracket 40 is made of a less expensive material (e.g., an untreated or low-strength steel). The bonnet 38 is made of a more durable, expensive material because it directly couples to the housing or choke body 42 were pressurized minerals create stress on the modular flow control system 12, while the modular bracket 40 is formed from a less expensive material because it is not in direct contact with the pressurized mineral flow. However, depending on environmental and operating conditions, the modular bracket 40 may be formed of a higher-strength, more expensive material than the first.

The stem assembly 36 is likewise made of two sections, one formed of more expensive durable material and one formed from a less durable and expensive material. The stem assembly 36 includes a first stem section 44 and a second stem section 46. The first stem section 44 is made of a more durable, expensive material (e.g., a higher-strength or treated steel) while the second stem section 46 is made of a less expensive material (e.g., an untreated or low-strength steel). The first stem section 44 experiences more stress and force as it moves within the housing or choke body 42 and the bonnet 38. Accordingly, the first stem section 44 is formed from a stronger more durable material that enables the first stem section 44 to withstand the conditions of the pressurized mineral flow through the modular flow control system 12. In contrast, the second stem section 46 is not in direct contact with the pressurized mineral flow and may therefore be formed from a less expensive material. Moreover, the modularity allows for, when desired and in view of the expected conditions, selection of appropriate materials for all bonnet and stem portions or just some of them as needed.

As explained above, the illustrated choke 12 includes a housing or choke body 42. Pressurized minerals enter the housing 42 through an inlet 48. The inlet 48 includes a flange 50 that connects the flow control system 12 to the Christmas tree 20. The inlet 48 enables the minerals to flow through the housing 42 and into a housing cavity or gallery 52. The cavity or gallery 52 enables the flow control system 12 to reduce the velocity of the fluid passing through the inlet 48. More specifically, the housing cavity or gallery 52 may have a cross-sectional area between 2.5-3.5 times the area of the inlet 48. However, in some embodiments the housing cavity or gallery 52 may have a cross-sectional area 3.5 or greater than the area of the inlet 48. The difference in area enables natural gas passing through the inlet 48 to expand and slow within the housing cavity or gallery 52. By slowing the gas, or other fluid, down, the cavity or gallery 52 reduces the momentum of particles (e.g., sand) traveling in the gas, which in turn reduces wear on components in the modular flow control system 12. After passing into the cavity 52 the modular flow control system 12 redirects the fluid towards the outlet 54. The outlet 54 includes a counter bore 56, a retaining surface 58, and a flange 60. The flange 60 enables the modular flow control system 12 to connect to the conduit 22 facilitating the flow of minerals away from the wellhead system 10.

The choke 12 controls the flow of minerals through the housing 42 with a modular flow control device 62. The flow control device 62 includes a cage 64, a floating sleeve 66, and the stem assembly 36. As illustrated, the cage 64 couples to the outlet 54 and rests within the cavity 52. Specifically, the cage includes an outer surface 68, passage 70, inlet apertures 72, and an outlet aperture 74. The outer surface 68 includes a retaining surface 76 and a floating sleeve contact surface 78. In order to couple the cage 64 to the housing 42, the cage 64 passes through the flow control device aperture 79 into the cavity 52 where it threads into the retaining surface 58 of the counterbore 56. In this position, the cage 64 prevents fluid from flowing directly from the inlet 48 to the outlet 54. Specifically, the fluid flows through the inlet 48 and into the cavity 52 where it enters the cage 64 through the inlet apertures 72. In the present embodiment, there are multiple apertures. In other embodiments, there may be different numbers of inlet apertures (e.g., 1, 2, 3, 4, 5, 10, 15, 20, or more). After passing through inlet apertures 72 the fluid flows through the passage 70 and exits the cage 64 through the cage outlet 74. The fluid then exits the housing 42 through the outlet 54.

In order to control the amount and the pressure of the fluid exiting the housing 42, the flow control device 62 includes the floating sleeve 66 and the stem assembly 36. The floating sleeve 66 connects to the stem assembly 36, which transmits force that then moves the floating sleeve 66. The forces moves the floating sleeve 66 in a manner that covers and uncovers the inlet apertures 72 (i.e., enabling fluid to flow into and out of the cage 64). As explained above, the stem assembly 36 includes a first stem section 44 and a second stem section 46. The first stem section 44 connects to the floating sleeve 66. Accordingly, the first stem section 44 may be made from a more durable material than that of the second stem section 46. In order to connect the first stem section 44 to the floating sleeve 66, the floating sleeve 66 includes an inner aperture 80 with a diameter 82. The diameter 82 of the aperture 80 enables the floating sleeve 66 to cover the cage 64 (i.e., to slide over the cage outer surface 68). The floating sleeve 66 may also include apertures 45 that allow pressure from the gallery 52 to enter the sleeve aperture 80 behind gasket 86. This blocks the pressure at the inlet 48 from creating a load imbalance on floating sleeve 66 in the closed position (e.g., block or resist movement of the floating sleeve 66). Furthermore, the floating sleeve 66 includes a wear sleeve 84 and a gasket 86 that rest in the respective counter-bore 88 and groove 90. The gasket 86 seals with the cage outer surface 68.

The floating sleeve 66 moves in response to force transmitted by the stem assembly 36. In order to connect the floating sleeve 66 to the stem assembly 36 the floating sleeve 66 defines an aperture 92 with a diameter 94. In some embodiments, the diameter 94 may prevent the first stem section 44 from completely passing through the floating sleeve 66. Specifically, the first stem section 44 defines a first end 96 and a second end 98. The first end 96 includes a flange 100 with a diameter 102. The diameter 102 of the flange 100 is larger than the diameter 94 of the floating sleeve aperture 92. Accordingly, as the first stem section 44 moves in direction 104, the first stem section 44 passes through the aperture 92 until the flange 100 contacts the floating sleeve 66. To maintain the flange 100 in contact with the floating sleeve 66, the first stem section 44 includes a retainer groove 106 that receives a split retainer 107. Once the flange 100 contacts the floating sleeve 66, the split retainer 107 couples to the first stem section 44 and rests in the retainer groove 106. Accordingly, the flange 100 and the split retainer 107 block separation of the first stem section 44 from the floating sleeve 66. In some embodiments, the split retainer 107 may allow sleeve 66 to axially move small distances on stem 44 to block binding.

As discussed above, the stem assembly 36 includes a second stem section 46 that couples to the first stem section 44. As illustrated, the second stem section 46 does not directly couple to the floating sleeve 66. Accordingly, the second stem section 46 may be formed from a less expensive material (e.g., low alloy steel, stainless steel, or other suitable material). The second stem section 46 connects to the second end 98 of the first stem section 44. Specifically, the second end 98 of the first stem section 44 defines a diameter 110 and a threaded surface 112. The threaded surface 112 threads into a first end 114 of second stem section 46. Specifically, the second stem section 46 includes a first end 114 and a second end 116. The first end 114 includes a threaded counterbore 118 with a diameter 120 equal to the diameter 110 of the second end 98 of the first stem section 44. Accordingly, the first stem section 44 couples to the second stem section 46 by threading the threaded surface 112 of the first stem section 44 into the threaded counterbore 118. In some embodiments, a lock washer 108 may be included between the first and second stem sections 44, 46. In operation, the lock washer 108 may block the separation of the first and second stem sections 44, 46 as the stem assembly 36 rotates.

As illustrated, the bonnet 38 connects to the housing 42, thus retaining the floating sleeve 66 within the housing 42. The bonnet 38 includes passageway 122, first counterbore 124, a second counterbore 126, and a flange 128. The passageway 122, first counterbore 124, and second counterbore 126 enable the stem assembly 36 to move within the bonnet 38. Indeed, the first counterbore 124 is sized to receive the floating sleeve 66 and to enable the floating sleeve to move in direction 104 and 110 as it covers and uncovers the inlet apertures 72 on the cage 64. As illustrated, the second counterbore 126 receives a gasket 130. In other embodiments there may be more gaskets that rest in the second counterbore 126 (e.g., 1, 2, 3, 4, 5, 6, 7, or more). The gasket 130 creates a fluid seal with the stem assembly 36 that blocks fluid from passing through the passageway 122 of the bonnet 38. As will be appreciated, the bonnet 38 couples to the housing 42 with bolts 132 that pass through the flange 128 and into the housing 42. In order to create a fluid seal between the bonnet 38 and the housing 42, a gasket 134 is placed in a gasket recess 136. After coupling the bonnet 38, the gasket 134 blocks fluid leaks between the bonnet section 38 and the housing 42. As illustrated, the bonnet 38 is in direct contact with the pressurized mineral flow, and surrounds components that are subject to the pressurized fluid flow (i.e., first stem section 44 and the floating sleeve 66). Accordingly, the bonnet 38 may be made out of a strong, durable material (e.g., alloy steel) in order to withstand the force and stress from the pressurized mineral flow.

The modular bracket 40 connects to the bonnet 38 with bolts 138. As illustrated, the modular bracket 40 does not connect to the housing 42 or communicate with the pressurized mineral flow. Accordingly, the modular bracket 40 does not experience significant stress and may therefore be made from a less expensive material (e.g., carbon steel, ductile iron). The modular bracket 40 includes passage 140, slot 142, and drive bushing counterbore 144. The passage 140 enables the second stem section 46 to connect to the drive bushing 146. As illustrated, the second end 116 of the second stem section 46 includes a threaded surface 148 and a threaded counterbore 150. The drive bushing 146 includes passage 152 with a threaded portion 154; and a flange 156. In order to connect the drive bushing 146 to the second stem section 46 the drive bushing 146 is inserted into the passage 140 until a thrust bearing 157 contacts the counterbore 144. The threaded surface 148 of the second stem section 46 is then inserted into the passage 140 and coupled to the threaded portion 154 of the drive bushing passageway 152. The drive bushing 146 is then secured retained within the modular bracket 40 with a cap 158.

The cap 158 includes a counterbore 160, a plurality of through holes 162, and a lock screw hole 164. The lock screw hole 164 receives a locking screw 165. The locking screw 165 facilitates actuator exchange by engaging the drive bushing 146, which prevents the drive bushing 146 from rotating (i.e., prevents the drive bushing 146 from increasing or decreasing fluid flow during actuator exchange). Cap 158 secures the drive bushing to the modular bracket 40 by passing over the drive bushing 146 until the counterbore 160 contacts another thrust bearing 157. Screws 166 are then inserted into the through holes 162 and into the blind tapped holes 168 in the modular bracket 40. The screws 166 are inserted into the holes 168 until flush with the cap 158 and apertures 162. In this manner, the cap 158 securely couples the drive bushing 146 to the modular bracket 40. The absence of the cap 158 during operation of the flow control system 12 would enable the pressurized mineral flow to force the floating sleeve 66, stem assembly 36, and the drive bushing 146 in direction 104. Accordingly, the cap 158 prevents the drive bushing 146 from sliding out of the modular bracket 40 from the force of the pressurized mineral flow acting on the stem 44.

Once the drive bushing 146 is secured, the manual actuator 30 or the powered actuator 32 may then couple to the flow control system 12 and provide torque to the drive bushing 146. The manual actuator 30 couples directly to the drive bushing 146 with screws 168. The manual actuator 30 includes a wheel 170 surrounding a drive bushing connecting cylinder 172. The connecting cylinder 172 includes a passageway 174 and apertures 176. The manual actuator couples to the flow control system 12 by sliding cylinder 172 over the drive bushing 146 until apertures 178 in the drive bushing 146 align with the apertures 176. Once aligned the screws 168 thread into the apertures 176 and 178 coupling the manual actuator 30 to the drive bushing 146. The powered actuator 32 likewise couples to the flow control system 12, but as will be explained in more detail below the powered actuator 32 couples to the cap 158.

During operation, torque from the manual actuator 30 or powered actuator 32 causes the drive bushing 146 to rotate within the cap 158 and the modular bracket 40. The rotation of the drive bushing 146 in turn causes stem assembly 36 to move in direction 104 or 110 depending on the rotation of the drive bushing 146. In order to prevent the stem 44 from rotating with the drive bushing 146, the flow control system 12 prevents the second stem section 46 from rotating. In other words, if the stem sections 44 and 46 were able to rotate with the bushing 146, the first stem section 44 could uncouple from the second stem section 46, in response to the actuators 30 or 32. Accordingly, the flow control system 12 includes a screw 171 to block rotation of the stem assembly 36. In order to block rotation, the screw 171 threads into an aperture 172 of the second stem section 46. Once the screw 171 couples to the second stem section 46, the slot 142 blocks rotation of the screw 171 about the axis of the modular bracket 40, and thus rotation of the second stem section 46. However, the slot 142 enables the screw 171 to move in directions 104 and 110. Thus, the drive bushing 146 is able to move the stem assembly 36 by threading the second stem section 46 in and out of the threaded portion 154 of the drive bushing 146. Wherein, one section may be formed from a more durable material and the other section from a less expensive material.

Figure 3:
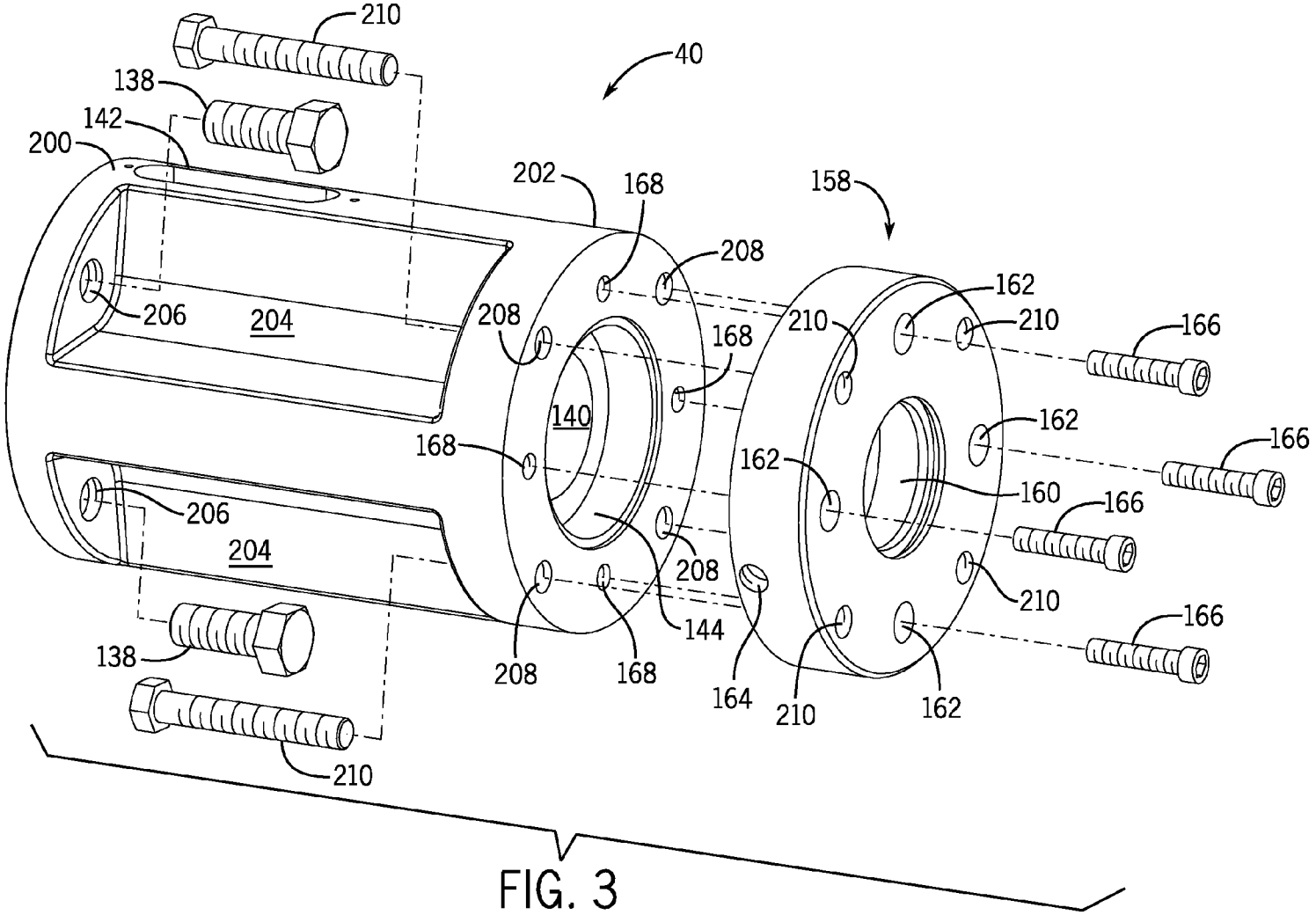
FIG. 3 is a perspective view of a modular bracket and a cap according to an embodiment.

FIG. 3 is a perspective view of the modular bracket 40 and the cap 158. As mentioned above, the powered actuator 32 connects to the flow control system 12 by coupling to the cap 158 and the modular bracket 40. The modular bracket 40 enables the powered actuator 32 to couple to the flow control system 12 without interrupting mineral flow. That is the modular bracket 40 is configured to remain coupled to the cap 158 during actuator exchange. As explained above, without the cap 158 the pressurized mineral flow would force the drive bushing 146 out of the modular bracket 40, preventing attachment of the powered actuator 32. As will be explained in greater detail below, the cap 158 and modular bracket 40 include apertures, these apertures enable the powered actuator 32 to couple to the flow control system 12 without removing cap 158. As illustrated, the modular bracket 40 includes a first end 200, a second end 202, grooves 204, slot 142, passageway 140, and counterbore 144. The modular bracket first end 200 includes apertures 206. These apertures 206 enable bolts 138 to couple the modular bracket 40 to bonnet 38. The second end 202 includes blind tapped holes 168 and apertures 208. The cap 158 couples to the modular bracket 40 with the screws 166 via the apertures 162 and the blind tapped holes 168. As will be appreciated, the slots 204 enable communication with the apertures 208, enabling the powered actuator 32 to couple without removal of the cap 158. More specifically, the grooves 204 enable bolts 210 to pass through the apertures 208 of the modular bracket 40, through the apertures 210 of the cap 158, and into the powered actuator 32 (seen in FIG. 5).

Figure 4:
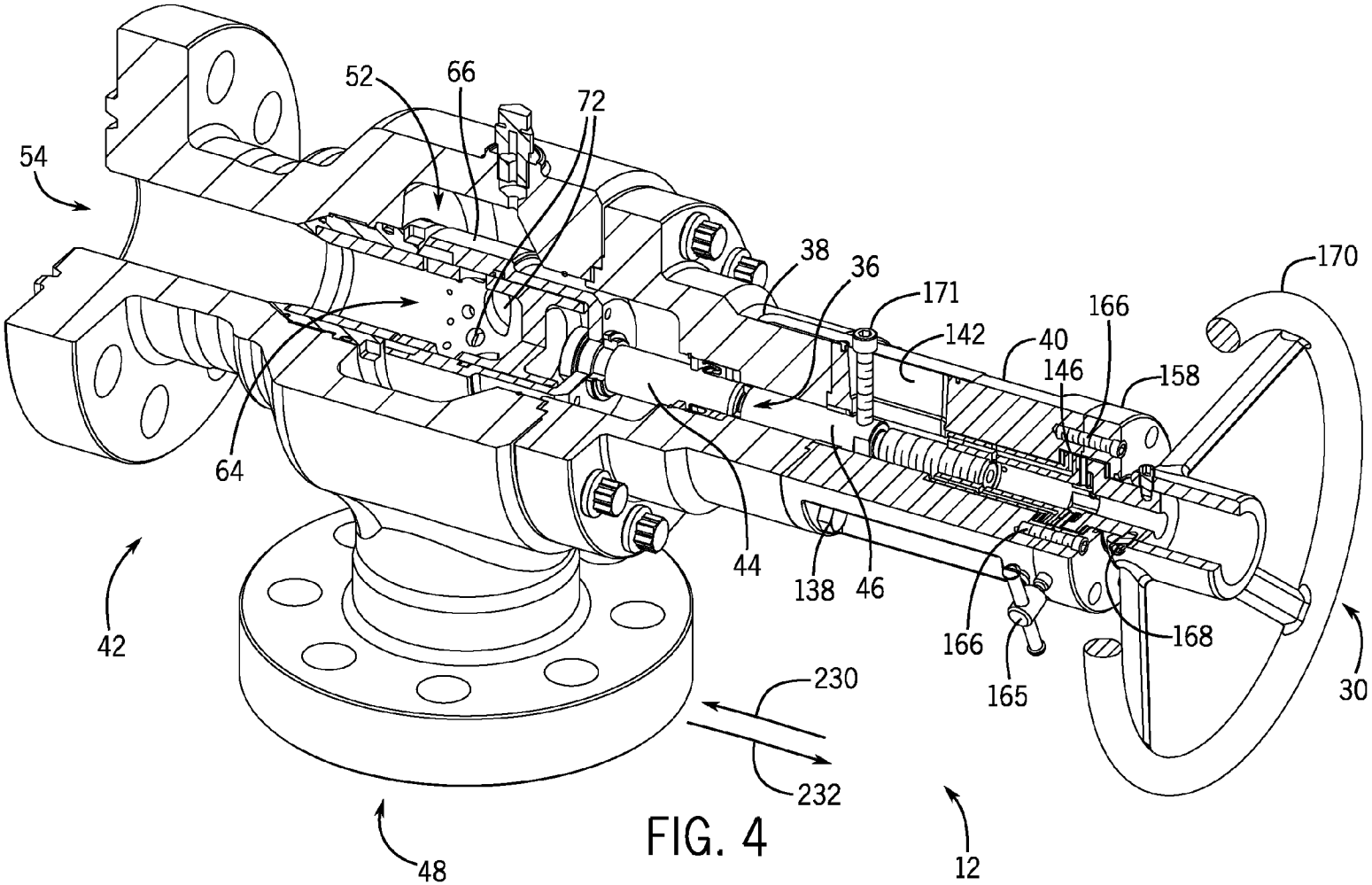
FIG. 4 is a partial cross-sectional perspective view of the modular flow control system with the manual actuator.

FIG. 4 is a partial cross-sectional perspective view of the modular flow control system 12 with the manual actuator 30. As illustrated, the cage 64 couples to and rests within the cavity 52 of the housing 42. In its current position the floating sleeve 66 covers the inlet apertures 72 of the cage 64 preventing mineral flow through the housing 42. In order to open the flow control system 12 an operator may actuate the manual actuator 30 by rotating the wheel 170. As explained above, the manual actuator 30 couples to the drive bushing 146 with screws 168. As the wheel 170 rotates, the wheel 170 induces the drive bushing 146 to rotate. Rotation of the drive bushing 146 induces the second stem section 46 to thread further into the drive bushing 146, thus moving the stem assembly 36 in direction 230. As explained above, if the second stem section 46 were able to rotate with respect to the first stem section 44 the stem assembly 36 would rotate with the drive bushing 146 and thus prevent movement of the floating sleeve 66 in response to the actuators 30 or 32. To prevent rotation of the stem assembly 36 the flow control system 12 includes the screw includes the screw 171. The screw 171 blocks rotation of the stem assembly 36, and therefore prevents the first stem section 44 from rotating with the drive bushing 146. In order to block rotation, the screw 171 threads into the second stem section 46, through the slot 142. Once the screw 171 couples to the second stem section 46, the slot 142 blocks rotation of the screw 171 about the axis of the modular bracket 40, and thus rotation of the second stem section 46. However, the slot 142 enables the screw 171 to move in directions 230 and 232. Thus, the drive bushing 146 is able to move the stem assembly 36 by threading the second stem section 46 in and out of the threaded portion 154 of the drive bushing 146. As the drive bushing 146 moves the stem assembly 36 further in direction 232 the stem assembly 36 induces the floating sleeve 66 to cover the inlet apertures 72, blocking pressurized mineral flow through the housing 42. Accordingly, the flow control system 12 may control the mineral flow out of the Christmas tree 18.

Figure 5:
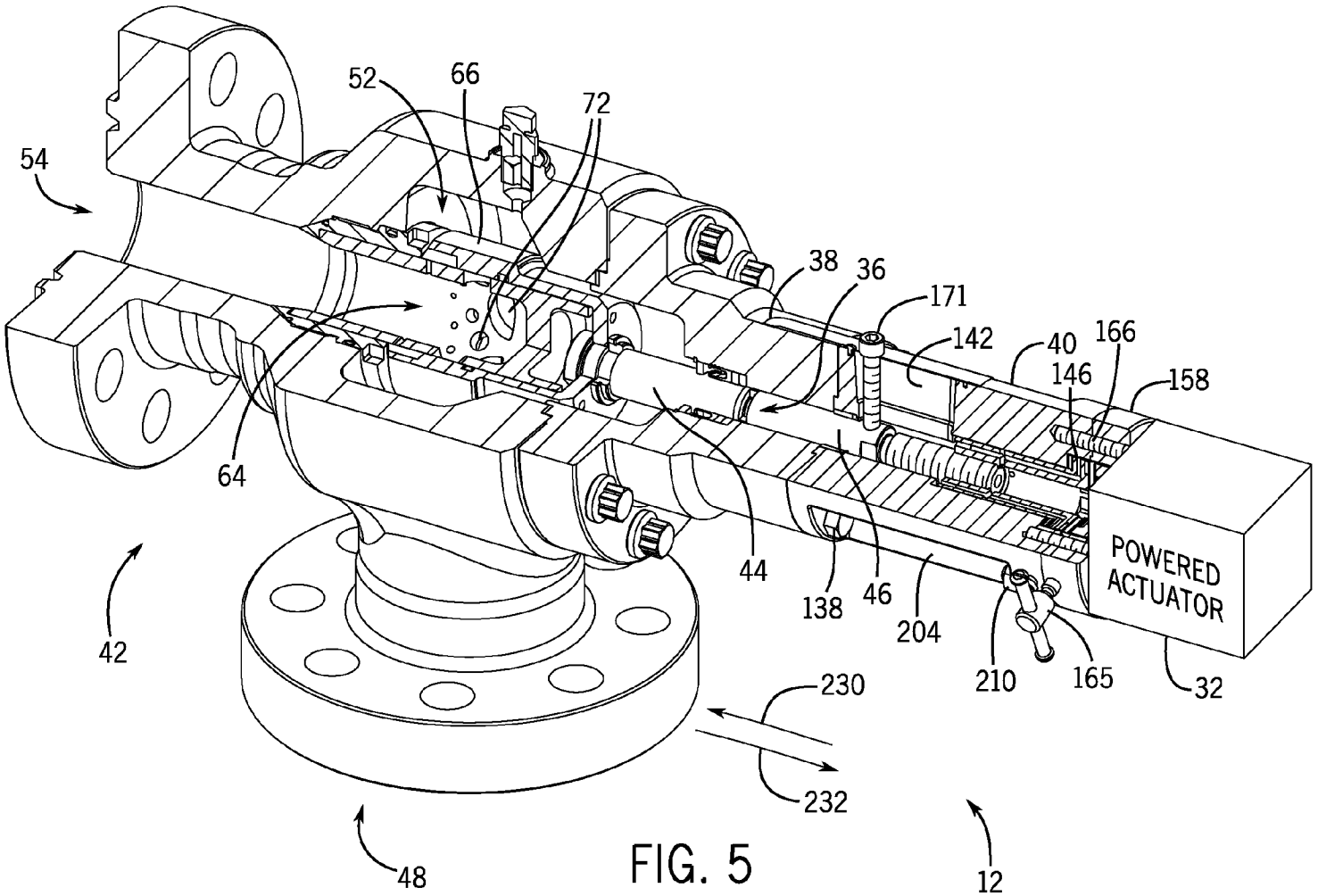
FIG. 5 is a partial cross-sectional perspective view of the modular flow control system with the powered actuator.

FIG. 5 is a partial cross-sectional perspective view of the modular flow control system 12 with the powered actuator 32. As explained above, the powered actuator 32 can be coupled to the system 12 without interrupting mineral flow. Indeed, the modular bracket 40 enables the powered actuator 32 to attach during actuator exchange without removing the cap 158. As explained above, without the cap 158 the pressurized mineral flow would force the drive bushing 146 out of the modular bracket 40. The cap 158 couples to the modular bracket 40 with screws 166 that keep the drive bushing 146 in place. The powered actuator 32 like the manual actuator 30 produces torque that induces movement of the floating sleeve 66. More specifically, the powered actuator 32 rotates the drive bushing 146. The drive bushing 146 then induces the second stem section 46 to thread further into or out of the drive bushing 146, thus moving the stem assembly 36 in direction 230 or 232. When the drive bushing 146 moves the stem assembly 36 further in direction 232, the floating sleeve 66 uncovers the inlet apertures 72, enabling pressurized mineral flow through the housing 42. Likewise, when the drive bushing 146 moves the stem assembly 36 in direction 230 floating sleeve 66 covers the inlet apertures 72, interrupting pressurized mineral flow through the housing 42. Accordingly, the flow control system 12 may control the movement mineral flow out of the Christmas tree 18.

Furthermore, and as explained above, the flow control system 12 may include components may from different materials (e.g., expensive and inexpensive materials). Indeed, some of the modular flow control system 12 may experience more stress and chemical attack than other components. As seen in FIGS. 4 and 5, the floating sleeve 66, the first stem section 44, and the bonnet 38 are in fluid communication with the cavity 52 and are therefore exposed to the stresses created by the pressurized mineral flow. Accordingly, these components may be made out of more durable materials (i.e., more expensive materials). Moreover, the modular bracket 40 and the second stem section 46 may be made out of less expensive materials because they are not in fluid communication with the pressurized fluid flow, and the associated forces. Thus, the modularity of the flow controls system 12 may reduce overall cost with different components made out of different materials.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a wellhead system; and a flow control system coupled to the wellhead system, wherein the flow control system comprises:

a housing with a flow path between an inlet and an outlet;

a flow control device disposed in the housing along the flow path;

a bonnet assembly surrounding the flow control device, wherein the bonnet assembly is configured to selectively mount one of a manual actuator and a powered actuator to actuate the flow control device; and at least one retainer to block movement of the flow control device during a change between the manual actuator and the powered actuator, wherein the at least one retainer comprises a lock screw that engages a drive bushing and wherein the lock screw is selectively movable against the drive bushing to block movement of the flow control device.

2. The system of claim 1, wherein the bonnet assembly includes a bonnet and a modular bracket configured to support first and second stem sections of a stem, wherein the bonnet, the modular bracket, the first stem section, and the second stem section remain the same when attaching the manual actuator or the powered actuator.

3. The system of claim 1, wherein the flow control device comprises a floating sleeve coupled to a stem and wherein movement of the stem is configured to move the floating sleeve between opened and closed positions.

4. The system of claim 3, wherein the stem includes a first stem section coupled to a second stem section, and wherein the first stem section is coupled to the floating sleeve and the second stem section is coupled to the drive bushing.

5. The system of claim 4, wherein the first stem section is formed from a first material and the second section is formed from a second material.

6. The system of claim 1, wherein the housing includes a cavity in fluid communication with the inlet and outlet, the cavity configured to slow a fluid entering the housing through the inlet.

7. The system of claim 1, wherein the bonnet assembly comprises a bonnet and a modular bracket, and the modular bracket is configured to couple to the bonnet and the manual actuator or the powered actuator.

8. The system of claim 7, wherein the bonnet is formed from a first material and the modular bracket is formed from a second material.

9. The system of claim 7, wherein the modular bracket receives the drive bushing and couples to a cap configured to retain the drive bushing within the modular bracket.

10. The system of claim 7, wherein the powered actuator comprises at least one of an electric actuator, a hydraulic actuator, or a pneumatic actuator.

11. The system of claim 1, wherein the bonnet assembly includes a bonnet and a modular bracket configured to support a stem, wherein the modular bracket remains the same when changing actuators between the manual actuator and the powered actuator.

12. The system of claim 1, wherein the bonnet assembly includes a bonnet and a modular bracket configured to support first and second stem sections of a stem, wherein the first and second stem sections remain the same when changing actuators between the manual actuator and the powered actuator.

13. A system comprising:

a modular flow control device; and a modular bonnet assembly configured to mount a plurality of different actuators to the modular flow control device while the modular flow control device operates to control flow in a flow control system, wherein the modular bonnet assembly includes a bonnet and a modular bracket, wherein the bonnet and the modular bracket remain the same when changing actuators.

14. The system of claim 13, wherein the modular flow control device includes a flow sleeve coupled to the stem, the first stem section is formed from a first material, and the second stem section is formed from a second material different from the first material.

15. The system of claim 13, wherein the bonnet is formed from a first material and the modular bracket is formed from a second material different from the first material.

16. The system of claim 13, wherein the bonnet, the modular bracket, the first stem section, and the second stem section remain the same when attaching a manual actuator or a powered actuator.

17. The system of claim 16, comprising a kit having the modular flow control device and the modular bonnet assembly, the manual actuator, the powered actuator, and instructions with steps to change between the manual actuator and the powered actuator during operation of the flow control system.

18. The system of claim 13, wherein the modular bonnet assembly is configured to support a stem having first and second stem sections, and the first and second stem sections remain the same when changing the actuators.

19. The system of claim 13, comprising at least one retainer to block movement of the modular flow control device during a change between different actuators.

20. A method comprising:

changing actuators of a flow control device using a bonnet assembly having a bonnet and a modular bracket while the flow control device operates to control flow in a flow control system, wherein the modular bracket remains the same when changing the actuators, and the actuators are different from one another.

21. The method of claim 20, comprising operating the flow control device and the flow control system with a manual actuator coupled to the flow control device, removing the manual actuator while the flow control device continues to operate, and mounting a powered actuator to the flow control device while the flow control device continues to operate, wherein the modular bracket remains the same when changing the actuators from the manual actuator to the powered actuator.

22. The method of claim 20, comprising operating the flow control system with a powered actuator coupled to the flow control device, removing the powered actuator while the flow control device continues to operate, and mounting a manual actuator to the flow control device while the flow control device continues to operate, wherein the modular bracket remains the same when changing the actuators from the powered actuator to the manual actuator.

23. The method of claim 20, comprising retaining a position of the flow control device with at least one retainer while changing the actuators by removing a first actuator from the flow control device and mounting a second actuator to the flow control device.

24. The method of claim 23, wherein the at least one retainer comprises a lock screw that engages a drive bushing, and the lock screw is selectively movable against the drive bushing to block movement of the flow control device.

25. The method of claim 20, wherein first and second stem sections of a stem supported by the bonnet assembly remain the same when changing the actuators.

26. The method of claim 25, comprising axially supporting the first and second stem sections of the stem with the bonnet assembly.

27. The method of claim 20, wherein the bonnet remains the same when changing the actuators.

28. The method of claim 20, wherein changing actuators comprises removing a first actuator and installing a second actuator while the modular bracket remains the same.

29. A method comprising:

changing actuators of a flow control device using a bonnet assembly having a bonnet and a modular bracket while the flow control device operates to control flow in a flow control system, wherein the modular bracket supports first and second stem sections of a stem, and the first and second stem sections remain the same when changing the actuators, and the actuators are different from one another.

30. The method of claim 29, wherein changing actuators comprises removing a first actuator and installing a second actuator while the first and second stem sections remain the same.

31. The method of claim 29, wherein the bonnet, the modular bracket, or both remain the same when changing the actuators.

32. The method of claim 29, wherein changing actuators comprises changing between a powered actuator and a manual actuator.

33. A system, comprising:

a flow control system, comprising:

a housing with a flow path between an inlet and an outlet;

a flow control device disposed in the housing along the flow path; and a bonnet assembly surrounding the flow control device, wherein the bonnet assembly is configured to selectively mount one of a first actuator and a second actuator to actuate the flow control device, the bonnet assembly comprises a bonnet and a modular bracket configured to support a stem, the modular bracket remains the same when changing actuators between the first actuator and the second actuator, and the first and second actuators are different from one another.

34. The system of claim 33, wherein the first actuator comprises a manual actuator and the second actuator comprises a powered actuator.

35. A system, comprising:

a flow control system, comprising:

a housing with a flow path between an inlet and an outlet;

a flow control device disposed in the housing along the flow path; and a bonnet assembly surrounding the flow control device, wherein the bonnet assembly is configured to selectively mount one of a first actuator and a second actuator to actuate the flow control device, the bonnet assembly comprises a bonnet and a modular bracket configured to support first and second stem sections of a stem, the first and second stem sections remain the same when changing actuators between the first actuator and the second actuator, and the first and second actuators are different from one another.

36. The system of claim 35, wherein the first actuator comprises a manual actuator and the second actuator comprises a powered actuator.

* * * * *